US007576280B2

(12) United States Patent
Lauffer

(10) Patent No.: US 7,576,280 B2
(45) Date of Patent: Aug. 18, 2009

(54) EXPRESSING MUSIC

(76) Inventor: James G. Lauffer, 15 Appaloosa La., South Hamilton, MA (US) 01982

( * ) Notice: Subject to any disclaimer, the term of this patent is extended or adjusted under 35 U.S.C. 154(b) by 57 days.

(21) Appl. No.: 11/561,757

(22) Filed: Nov. 20, 2006

(65) Prior Publication Data

US 2008/0115659 A1 May 22, 2008

(51) Int. Cl.
*G10H 1/02* (2006.01)

(52) U.S. Cl. ..... 84/626; 84/470 R; 84/477 R; 84/483.2

(58) Field of Classification Search ..... 84/477 R, 84/609, 470 R, 483.2, 649
See application file for complete search history.

(56) References Cited

U.S. PATENT DOCUMENTS 347,686 A * 8/1886 Carpenter et al. ..... 84/483.1
3,700,785 A * 10/1972 Leonard ..... 84/470 R
4,041,828 A * 8/1977 Leonard ..... 84/471 R
5,153,829 A * 10/1992 Furuya et al. ..... 84/622
5,690,496 A * 11/1997 Kennedy ..... 434/307 R
6,121,529 A * 9/2000 Nakata et al. ..... 84/477 R
6,150,598 A * 11/2000 Suzuki et al. ..... 84/603
6,192,372 B1 * 2/2001 Yamaura et al. ..... 707/104.1
6,204,441 B1 * 3/2001 Asahi et al. ..... 84/470 R
6,239,344 B1 * 5/2001 Prevost ..... 84/471 R
6,313,387 B1 * 11/2001 Yamauchi ..... 84/609
6,362,411 B1 * 3/2002 Suzuki et al. ..... 84/626
6,635,816 B2 * 10/2003 Funaki ..... 84/477 R
6,921,855 B2 * 7/2005 Tanaka ..... 84/477 R
6,987,220 B2 * 1/2006 Holcombe ..... 84/483.2
7,439,438 B2 * 10/2008 Hao ..... 84/483.2
2001/0047717 A1 * 12/2001 Aoki et al. ..... 84/611
2002/0066358 A1 * 6/2002 Hasegawa et al. ..... 84/609
2002/0170415 A1 * 11/2002 Hruska et al. ..... 84/609
2003/0079598 A1 * 5/2003 Nakayama ..... 84/609
2003/0167903 A1 * 9/2003 Funaki ..... 84/477 R
2004/0112202 A1 * 6/2004 Smith et al. ..... 84/609
2004/0244567 A1 * 12/2004 Asakura ..... 84/613
2004/0255755 A1 * 12/2004 Kestenbaum et al. ..... 84/483.2
2005/0204901 A1 * 9/2005 Hasebe ..... 84/600
2005/0257666 A1 * 11/2005 Sakurada ..... 84/609
2006/0252503 A1 * 11/2006 Salter ..... 463/25
2007/0028754 A1 * 2/2007 Hall ..... 84/745
2007/0089590 A1 * 4/2007 Katou ..... 84/609

* cited by examiner

*Primary Examiner*—Walter Benson
*Assistant Examiner*—Kawing Chan
(74) *Attorney, Agent, or Firm*—Occhiuti Rohlicek & Tsao LLP

(57) ABSTRACT

Expressing a musical work includes identifying a series of musical moments in the musical work and electronically specifying values for levels of each musical moment in the series. The electronically-specified values for at least one level are displayed.

78 Claims, 12 Drawing Sheets

10

12

14

| | |
|---|---|
| general direction, metronome marking | |
| general moment direction | |
| cec, eec, uec | |
| fermata, miscellaneous instructions | |
| phrasing | |
| key-sig, time-sig, measure #, open-repeat | |
| register, inflection | |
| note-name, accidental | |
| fingerings | |
| velocity | |
| duration | |
| starting point | |
| cdg, edg, udg | |
| dynamics, crescendo/decrescendo | |
| moment-specific comment | |
| pedaling | |
| cic, eic, uic | |
| Line designation | |

FIG. 3C

10'

12

14

| | |
|---|---|
| general direction, metronome marking | Allegro con Brio |
| general moment direction | |
| cec, eec, uec | |
| fermata, miscellaneous instructions | |
| phrasing | |
| key-sig, time-sig, measure #, open-repeat | 1, 1 |
| register, inflection | |
| note-name, accidental | 16 |
| fingerings | L5 |
| velocity | |
| duration | |
| starting point | |
| cdg, edg, udg | 2,1,1 |
| dynamics, crescendo/decrescendo | 4 |
| moment-specific comment | |
| pedaling | 1,-1,1 |
| cic, eic, uic | |
| Line designation | |

FIG. 3D

EXPRESSING MUSIC

BACKGROUND

Common ways to express a musical work in writing include standard musical notation. FIG. 1 shows the beginning portion of a fugue by Johann Sebastian Bach expressed in standard musical notation.

In standard musical notations, a musical work is formed from a series of measures 1. Each measure 1 may contain notes 2 and rests 3. Notes 2 depict certain tones which are determined based on a clef 4, a key signature 5, and the note's position on a staff 6. Rests 3 depict the absence of a tone. The duration with which a note 3 is played is determined by the shape of the note, as well as a time signature 7.

Beyond the tone and duration of a particular note 3, standard musical notation can be used to describe numerous other aspects of a musical work, such as the tempo at which the work is played, the loudness or softness of a certain note, whether one note flows smoothly or discretely to the next note, etc.

Various computer programs exist by which a person can express a musical work in standard musical notation, or other ways.

Some expressions of a musical work do not fully and unambiguously indicate the exact way to perform the musical work. For example, in FIG. 1, there is no indication of the tempo at which to play the musical work. In such circumstances, a performer can supply the missing details. This is referred to as "interpreting" the musical work.

Some musical works are amenable to several different interpretations. Interpreting a musical work can involve adding, removing, or changing musical features of the original work. For example, interpretations of musical works may differ as to the speed with which certain passages are played, the volume with which certain notes are played, etc. Various interpretations of a musical work may be of interest. For example, interpretations of a famous musical work by various accomplished performers can be used to gain insight into the musical work, the individual performers, musical techniques, etc.

Similarly, different musical performers of the same skill level, each playing from the same written expression of a musical work, will often perform the musical work differently. The differences are due, in part, to nuances or interpretations the respective performers impart to their performances. In some instructional contexts, such as a master class or clinic, one or several accomplished performers will perform a work. The students in attendance have the opportunity to learn new aspects of the musical work, by observing how each accomplished performer played the musical work. Often, a student who has learned something about a musical work annotates a pre-existing written expression of the work to indicate what the student learned. However, over the course of time, a student may be exposed to (or independently develop) several ideas about a single musical work. Thus, annotating a single written expression of the work with each idea may result in confusion from the sheer number of annotations, or if the ideas are conflicting (e.g., one idea involves playing a passage quickly, but another idea involves playing the passage slowly). To avoid this confusion, the student may use several copies of the same musical work, and limit annotations on one copy to ideas learned from a particular instructor. This approach, however, may be cumbersome to the student, and therefore some students do not record (by annotating or otherwise) at least some of the ideas that occur to them over time. It is therefore desirable for such a student to conveniently be able to clearly and conveniently record musical ideas, in particular as annotations on an existing musical work.

SUMMARY

In general, in one aspect, expressing a musical work includes: identifying a series of musical moments in the musical work; electronically specifying values for each of a plurality of levels of each musical moment in the series; and displaying the electronically-specified values for at least one level in the plurality of levels.

Implementations may have one or more of the following features. The values for the at least one level are displayed visually. The values for the at least one level are displayed in non-overlapping areas. The values for the at least one level are displayed aurally. The values for the at least one level are displayed simultaneously aurally and visually. The values for the at least one level are displayed at a speed based on a rhythmic pattern of the musical work. The values for the at least one level are displayed at a speed based on a rhythmic pattern supplied by a user. The values for the at least one level include values for at least one note of the musical work, and the values for the at least one level are displayed contemporaneously with a rythmic pattern of the at least one note. The values for the at least one level of each moment are displayed in response to input from a user. The electronically-specified values of less than all of the plurality of levels are displayed. The values of the levels are displayed based on a filter. The plurality of levels includes a level for the general direction of the musical work or a metronome marking. The plurality of levels includes a level for the general direction of a moment in the series of moments. The plurality of levels includes a level for comments about the musical work. The plurality of levels includes a level for musical graphics. The plurality of levels includes a level for phrasing instructions. The plurality of levels includes a level for a key signature for a moment in the series of moments. The plurality of levels includes a level for a time signature for a moment in the series of moments. The plurality of levels includes a level for a measure number for a moment in the series of moments. The plurality of levels includes a level for an open repeat instruction. The plurality of levels includes a level for register information for a note or notes in a moment in the series of musical moment. The plurality of levels includes a level for an inflection instruction for a moment in the series of musical moments. The plurality of levels includes a level for a note name or names for a note or notes in a moment in the series of musical moments. The plurality of levels includes a level for a fingering instruction for a moment in the series of musical moments. The plurality of levels includes a level for a velocity for a moment in the series of musical moments. The plurality of levels includes a level for a duration for a moment in the series of musical moments. The plurality of levels includes a level for a line designation for one or more notes in a moment in the series of musical moments. The plurality of levels includes a level for a closed repeat for a moment in the series of musical moments. The plurality of levels includes a level for a starting point for a moment in the series of musical moments. The plurality of levels includes a level for dynamics for a moment in the series of musical moments. The plurality of levels includes a level for a moment-specific direction for a moment in the series of moments. The plurality of levels includes a level for a pedaling instruction for a moment in the series of moments. The plurality of levels includes a level for comments about a musical moment in the series of musical moments. Expressing a musical work also includes identifying a second series of musical moments expressing a second musical work, the second series of moments including values for each of a second plurality of levels of each musical moment in the second series, and displaying the values for at least one level in the second plurality of levels simultaneously with displaying the values for at least one level in the first plurality of levels. Expressing a musical work also includes displaying an electronic representation of a musical instrument. Displaying the electronically-specified values includes displaying the electronically-specified values on the electronic representation of the musical instrument. Electronically specifying values includes electronically specifying values in response to electronic interaction with the electronic representation of a musical instrument. The musical instrument includes a piano keyboard. The musical instrument includes a stringed instrument.

Implementations may have one or more of the following advantages. Multiple editions of a single musical work can be conveniently organized or compared. Inputting musical moments can be accomplished relatively quickly. Practice and study can be accomplished without the musician's instrument. It is relatively difficult to unintentionally ignore aspects of the musical work. Aspects of a musical work can be intentionally suppressed.

BRIEF DESCRIPTION OF THE DRAWINGS

FIGS. 3C and 3D show exemplary musical moments.

DESCRIPTION

Figure 2:
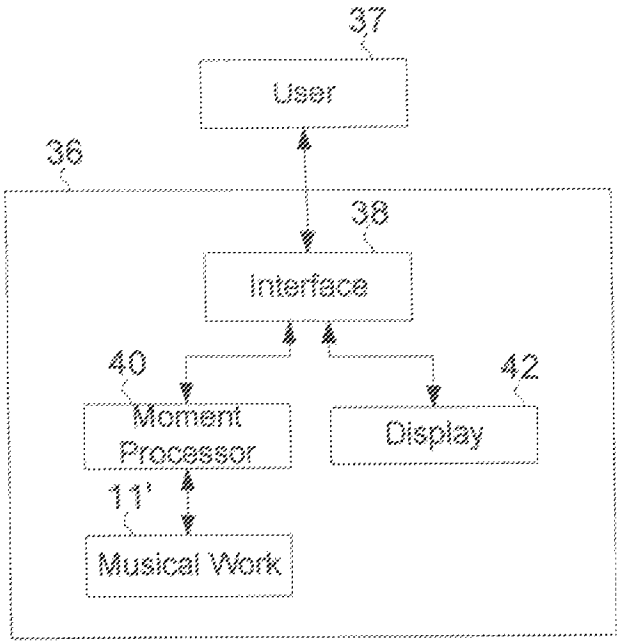
FIG. 2 is a schematic depiction of a musical workstation.

Referring to FIG. 2, a musical workstation 36 includes a moment processor 40, an electronic expression 11' of a musical work 11, and a display 42. The components 11', 38, 40, and 42 of the musical workstation 36 are all in mutual data communication, either directly or indirectly via other components. Each of the components 11', 38, 40, and 42 may be implemented as hardware, software, or a combination of hardware and software. A user 37 interacts with the musical workstation 36 through an interface 38. In some implementations, the musical workstation 36 includes a microcomputer such as a laptop computer or a portable desktop organizer (PDA).

The musical workstation 36 uses a concept of a "musical moment," or simply "moment." As described more fully below, a musical moment is akin to a fundamental unit of music, as by analogy, a word is akin to a fundamental unit of language.

The musical workstation 36 allows a musician to conveniently express musical ideas using musical moments. The expressions can be electronically stored and organized on the musical workstation 36 or elsewhere. Among other things, expressing recording, and organizing musical ideas that occur to a musician allows the musician to trace the evolution of his musical understanding over the course of time. Tracing this evolution can be instructive for the musician or others. The use of musical moments and musical workstation 36 also helps a musician to overcome the difficulties associated with annotating or expressing musical works, among other difficulties.

Similarly, the musical workstation 36 can be used as a research tool. When musical works are expressed as a series of musical moments, comparing different musical works is relatively easy. For example, the nuances in different editions of the same musical work can be identified and compared relatively easily.

Moreover, as described more fully below, the musical workstation 36 allows a musician to practice a musical work without his instrument. Such process is particularly effective due in part to the logical structure of a musical moment. In particular, a musician can focus only on desired aspects of a musical work, with the musical workstation 36 suppressing the non-desired aspects from the musician.

Figure 3B:
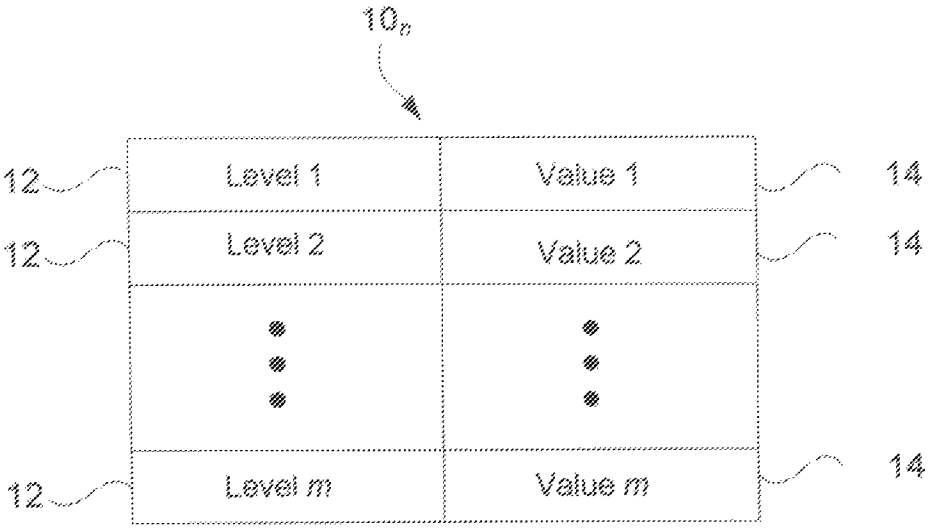
FIG. 3B is a schematic representation of a musical moment of FIG. 3A.
Figure 3A:
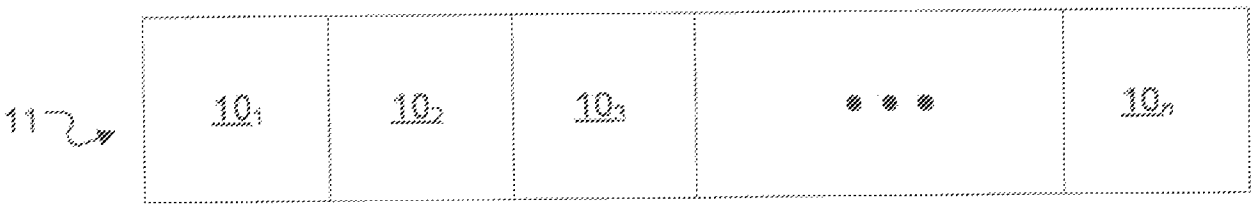
FIG. 3A is a schematic representation of a musical work as a sequence of musical moments.

Referring to FIG. 3A, a musical work 11 is expressed as a string of musical moments $\mathbf{10}_1, \ldots, \mathbf{10}_n$. Each musical moment $\mathbf{10}_1, \ldots, \mathbf{10}_n$ has a relative position or time-ordering within the musical work 11, so that the entire musical work 11 can be performed by performing each musical moment $\mathbf{10}_1, \ldots, \mathbf{10}_n$ in succession. A single measure with more that one note or chord generally contains several musical moments $\mathbf{10}_1, \ldots, \mathbf{10}_n$, each moment corresponding to a single tone or chord. Such measures may also include additional musical moments that do not correspond to any tones or sounds.

In FIG. 3B, a musical moment $\mathbf{10}_1$ includes one or more levels 12, and each level 12 may possess one or more values 14. In any particular moment $\mathbf{10}_1, \ldots, \mathbf{10}_n$, it is permissible for some or all levels 12 to have no value 14. Each level 12 represents a discrete, fundamental aspect of the musical moment $\mathbf{10}_1$. For example, each musical moment $\mathbf{10}_1, \ldots, \mathbf{10}_n$ in a musical work 11 may include a level 12 that corresponds to the tone or tones that are included in a particular musical moment. Another level 12 may include the duration for which the tone or tones are played, etc.

In a particular musical moment $\mathbf{10}_1$,each of one or more levels 12 may have a value 14. A given level 12 may have different values 14 in different musical moments $\mathbf{10}_1, \ldots, \mathbf{10}_n$ for the same musical work 11. For example, in a simple case of a musical scale, each note of each musical moment $\mathbf{10}_1, \ldots, \mathbf{10}_n$ is different from the note in adjacent musical moments.

The values 14 in any given level 12 may be text or numerical values. The values 14 in any given level 12 may directly indicate a musical aspect of the level 12, or may indirectly indicate a musical aspect of the level 12. An example of indirect indication is a value 14 that serves as a pointer to a dictionary or lookup table.

As used herein, the term "musical work" refers to a string of moments $\mathbf{10}_1, \ldots, \mathbf{10}_n$ that has particular values 14 in particular levels 12. Thus, different series of moments $\mathbf{10}_1, \ldots, \mathbf{10}_n$ that differ only slightly (for example, have different values 14 in only one level 12 of only one moment 10_m) are considered in this document to describe different musical works 11, even if they are commonly understood to be merely different editions of a single musical composition. In particular, the term "musical work" includes a series of moments $\mathbf{10}_1, \ldots, \mathbf{10}_n$ that form only a small part of a larger musical work. Indeed, a musical work may contain only a single musical moment.

In FIG. 3C, an exemplary musical moment 10 is shown. The levels in this moment are summarized in table 1:

TABLE 1

| | | |
|---|---|---|
| 1 | general direction, metronome marking | Describes a default or general tempo or mood for the musical work. This may include a metronome marking. |
| 2 | general moment direction | Describes a tempo or mood for the particular musical moment, perhaps contrary to the general direction. |
| 3 | cec, eec, uec | Contains composer-, editor-, or user-defined external comments to be displayed with the musical moment. |
| 4 | fermata, miscellaneous instructions | Signifies the presence or absence of a fermata in the musical moment. The presence or absence of other musical features not described in another moment, as required by the particular musical work, may also be included in this level. |
| 5 | Phrasing | Describes a grouping of the current moment with other moments to form phrases. |
| 6 | key-sig, time-sig, measure #, open-repeat | The key signature and time signature of the moment, as well as the measure's number and whether the moment marks an open-repeat. |
| 7 | register, inflection | The register in which the note resides, and the inflection with which a particular note is played. |
| 8 | note-name, accidental | The name of one or more notes that are present in the musical moment. The note name may be in any known language, including a user-defined language. |
| 9 | Fingerings | Describes which finger or fingers of which hand should play the note or notes described in level 8. |
| 10 | Velocity | The loudness of a particular note in the moment. |
| 11 | Duration | The duration with which a particular note is played. |
| 12 | starting point | The starting point of a moment relative to the musical work (i.e., relative to a measure, or another moment). |
| 13 | cdg, edg, udg | Determines which, if any, composer-, editor-, or user-defined graphics are displayed in the musical moment. |
| 14 | dynamics, crescendo/ decrescendo | Describes the dynamic qualities of the musical moment, including whether the moment is part of a crescendo or decrescendo. |
| 15 | moment-specific comment | Contains instructional, historical, or other comments to be displayed with the musical moment. |
| 16 | Pedaling | Describes whether to depress or release a pedal during the musical moment. |
| 17 | cic, eic, uic | Contains composer-, editor-, or user-defined internal comments to be displayed with the musical moment. |
| 18 | Line designation | Data that associates a particular note in a moment with one or more lines, possibly user-defined lines, e.g., lines in a fugue, melody or bass lines, etc. |

Generally, the items in the above table are meant to have their ordinary musical meanings. The meanings of these terms will be explained more fully below (see FIGS. 6A-K). These level definitions are meant to be exemplary only. In principle, any number of levels 12 may be used to define each moment $\mathbf{10}_1, \ldots, \mathbf{10}_n$. Moreover, users may be able to define new levels 12 as they require.

In FIG. 3D, the exemplary musical moment 10' of FIG. 3C is shown, with values provided. This musical moment is the first musical moment from Beethoven's Waldstein sonata. In FIG. 3D, values 14 for only some levels 12 are provided. In general, a musical moment $\mathbf{10}_n$ need not have values 14 in each of its levels 12. As shown in FIG. 3D, the values 14 of the "general direction" and "fingering" levels 12 are direct indications of musical aspects of the respective levels; "allegro con brio" has a well-known musical meaning, and "L5" directly indicates using the fifth finger of the left hand to play the note. One the other hand, the remaining values 14 are indirect indications of the musical aspects of the remaining levels. In particular, the remaining values 14 are pointers to one or more dictionaries or lookup tables. These dictionaries or lookup tables can be one dimensional (i.e., one number uniquely specifies a dictionary entry, as in the "note-name, accidental" level 12), or multi-dimensional or hierarchically organized (i.e., more that one number is required to uniquely specify a dictionary entry, as in the "cdg, edg, udg" level 12).

In some implementations, expressing a musical work 11 (or a portion of a musical work 11) involves specifying the values 14 for the various levels 12 in the moments $\mathbf{10}_1, \ldots, \mathbf{10}_n$ in the musical work 11. These values 14 may be electronically specified. For example, the musical work 11 may be expressed and stored in a musical workstation 36. Since expressing a musical work amounts to merely specifying values 14, a musical work 11 may be expressed relatively quickly compared to more traditional ways to express music (e.g. in standard musical notation). In some implementations, for example, the values 14 may be entered relatively easily in a musical workstation 36. Moreover, in some implementations, values 14 are amenable to standard cut-and-paste functionality. For example, values 14 of a particular level 12 across several moments $\mathbf{10}_1, \ldots, \mathbf{10}_n$ can be easily reproduced.

Figure 4A:
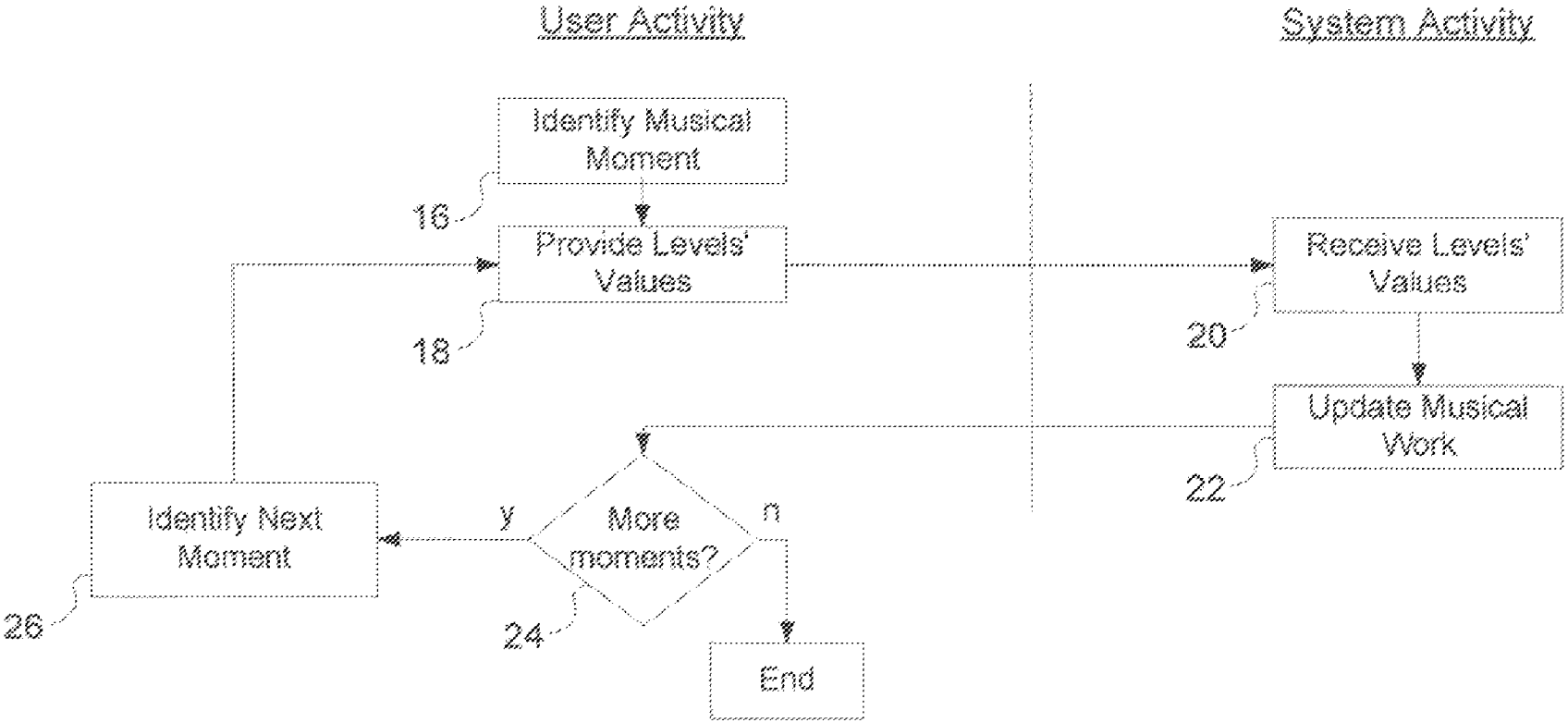
FIG. 4A is a flowchart for expressing a musical work.

Referring to FIG. 4A, a user who seeks to express a musical work 11 can begin by identifying a musical moment $\mathbf{10}_1$ in the musical work 11 (step 16). The first musical moment $\mathbf{10}_1$ of the musical work 11 is used here as an example; any musical moment $\mathbf{10}_1, \ldots, \mathbf{10}_n$ of the musical work 11 can be identified in step 16. In step 18, the user provides the values 14 of the musical moment $\mathbf{10}_1$ to a musical workstation 36 (FIG. 2). The musical workstation 36 receives the values 14 (step 20), and updates an expression of the musical work 11 that it has stored (step 22), to reflect the values 14 it received in step 20.

The user decides whether to include more musical moments in the passage he wishes to express (step 24). If there are more musical moments in the passage, the user identifies the next musical moment (step 26) and repeats steps 18-22. Eventually, the user decides that enough musical moments have been entered.

Optionally, the portion of the musical work 11 entered in steps 18-26 can be checked against a pre-existing portion of the musical work 11. For example, the musician may wish to "quiz" himself by entering the portion of the musical work 11 from memory.

Expressing a musical work 11 using moments $\mathbf{10}_1, \ldots, \mathbf{10}_n$ allows a musician to parse out, moment-by-moment, various aspects of the musical work 11. One context in which such parsing may be employed is when the musician studies or practices the musical work 11. In the musical workstation 36 described above (see FIG. 2), each level 12 of the moments $\mathbf{10}_1, \ldots, \mathbf{10}_n$ of the musical work can be displayed or suppressed. By doing so, the musician can practice or study the musical work 11 more efficiently than other traditional techniques involving traditional musical notation.

For example, if the musician is interested in practicing or studying an aspect of the musical work 11 that is expressed in a particular level 12, displaying only this level 12 while suppressing the remaining levels 12 can help the musician focus on the salient aspect of the musical work 11. For some musicians, this technique can result in rapid progress in learning the musical work 11, and ultimately result in enhanced productivity for the musician.

Moreover, for some musicians (for example, amateur musicians), focusing only on certain aspects of a musical work 11 can help prevent the musician from feeling overwhelmed with the challenge of mastering the musical work 11, or from feeling frustrated with a lack of progress that may have resulted from more traditional techniques. In some cases, such frustration can even lead the musician to cease the pursuit of music.

Figure 4B:
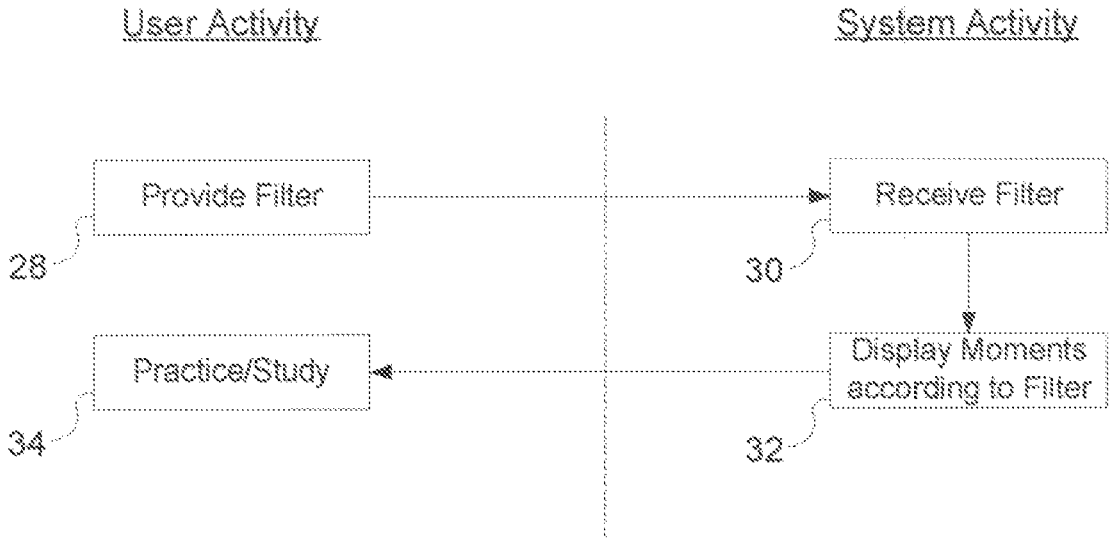
FIG. 4B is a flowchart for displaying a musical work.

Referring to FIG. 4B, to study or practice the musical work 11, the user provides a filter to the musical workstation 36 (step 28). This filter specifies one or more levels 12 and/or certain values 14 in a given level 12 that the user would like to suppress. For example, if the user is interested in practicing just the left-hand portion of the musical work 11, the user would include the right-hand portion in the filter.

Figure 1:
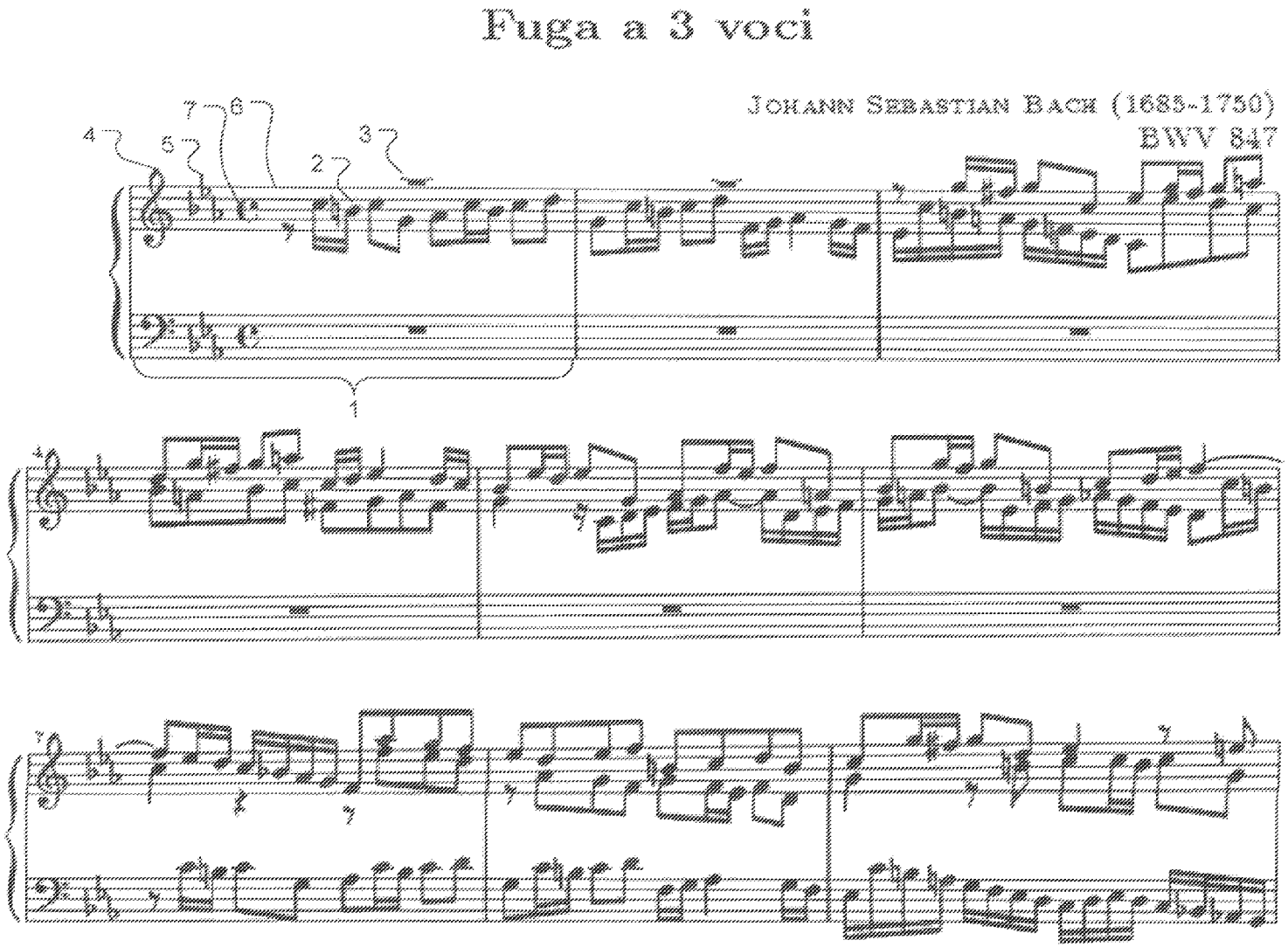
FIG. 1 is a representation of a musical work in a common notation.

The musical workstation 36 receives the filter (step 30), and displays the musical moments of the work, while suppressing the levels 12 of each musical moment specified by the filter (step 32). The user, now presented with only the information he is interested in, proceeds to practice or study (step 34). The filter may be empty, in which case every level of the musical work is displayed. The ability to filter the various levels 12 of the musical work 11 allows the user to treat the musical work 11 as an interactive document, rather than merely as a traditional musical score as shown in FIG. 1.

As used herein, "practice" includes, but is not limited to, physically practicing the musical work 11 with a musical instrument. In particular, "practice" includes mentally rehearsing such physical practice. Thus, the musician may employ the steps above to practice a musical work away from the musician's instrument. In some instances, practicing away from the instrument helps the musician develop an intellectual understanding of the musical work 11, and cement physical "touch and feel" reflexes associated with performing the musical work 11.

In general, there is no requirement that a single entity carry out the steps called for above in FIG. 4A or 4B. For example, one or more people may input a musical work into the musical workstation 36 (steps 16, 18, 24, 26), while another person uses the musical workstation 36 to practice the musical work (steps 28, 34).

Referring again to FIG. 2, and as discussed above, each of the components 11', 38, 40, and 42 may be implemented as hardware, software, or a combination of hardware and software. For example, each of the components may be stored on a data storage medium such as an optical or magnetic data storage device, including a hard drive, a compact disc, static or non-static memory, or a microprocessor configured to perform as described below.

The data communication between any two components of the musical workstation 36 may be implemented by direct physical connection using a wire or a fiber optic cable, or by transmitting and receiving data wirelessly. The data communication may be implemented in the absence of a network, over a local area network, or a wide area network such as the Internet.

The display 42 may include hardware for producing visual output, audio output, or a combination of visual and audio output. For example, the display 42 may play a portion of the musical work back over an audio speaker at a pre-defined or user-selected speed. The display 42 may also visually scroll through the musical moments at a pre-defined or user-selected speed, either simultaneously with or separately from an audio playback. The visual scrolling may include a graphic representation of each musical moment, a simulated performance of each musical moment on an electronic representation of an instrument, or both (see FIG. 5).

The user 37 interacts with the musical workstation 36 through the interface 38. The interaction includes causing the musical workstation 36 to display the musical work 11' (possibly through a pre-defined or user-provided filter), and editing the musical work 11'.

When the user provides a filter for displaying the moments in the musical work 11', the moment processor 40 suppresses the level data of the musical work 11' called for by the filter. Furthermore, when the user 37 edits the musical work 11', the moment processor 40 converts the input received by the user 37 through the interface 38 into data formatted consistently with the musical work 11', which is then written to the musical work 11'.

Figure 5:
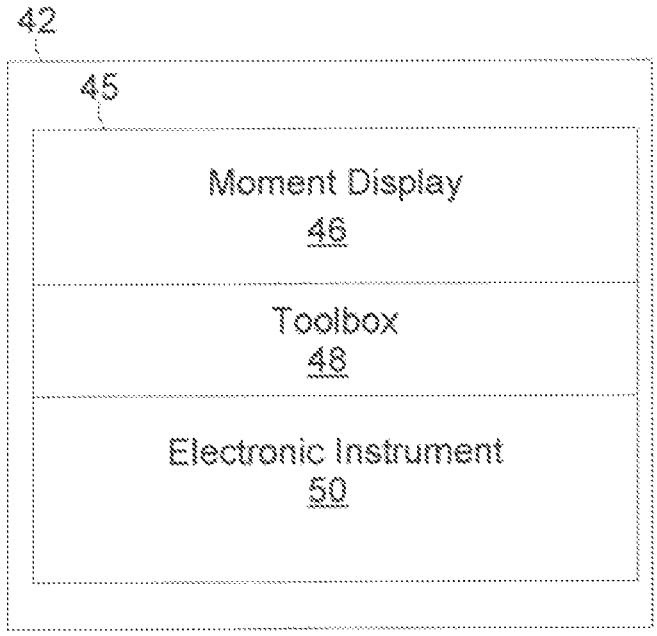
FIG. 5 is a schematic depiction of video output provided by the musical workstation.

Referring to FIG. 5, in some embodiments, the output includes video output 45 with three portions: a moment display portion 46, a toolbox 48, and an electronic representation of a musical instrument 49.

The moment display portion 46 is for displaying musical moments $10_1, \ldots, 10_n$ of the musical work 11. In some implementations, the moments $10_1, \ldots 10_n$ so that the values 14 of each moment's respective levels 12 are displayed in non-overlapping regions within the moment display portion 46. If a filter has been provided, then the values 14 of the filtered levels 12 are not displayed. In some implementations, the musical moments $10_1, \ldots, 10_n$ are displayed horizontally across the moment display portion 46 as a time-ordered series of discrete, rectangular regions. Each rectangular region is sub-divided (for example, into smaller non-overlapping rectangles), with the value 14 of each level 12 of the moment appearing in a different subdivision.

In some implementations, the moment display portion 46 can be partitioned to display the musical moments $10_1, \ldots, 10_n$ of more that one musical work 11. For example, this can be used to compare different editions of a musical composition simultaneously.

The moments $10_1, \ldots, 10_n$ of the musical work 11 can be displayed in groups (e.g., single moments, screens, etc.), or can be animated. In some implementations, moments are displayed at a constant rate. In some implementations, the musical moments are displayed consistently with the rhythmic pattern of the musical work 11. That is, a particular musical moment can be displayed contemporaneously with when the moment is played in the musical work 11. This rhythmic pattern can be modified by the user 37. For example, the user 37 can specify a tempo at which the musical work 11 will be displayed. In some instances, such animated visual display of the musical moments $10_1, \ldots, 10_n$ provides a visual cue to the musical work's rhythmic pattern that helps solidify the musician's physical reflexes. In some implementations, the user 37 can specify a constant tempo (e.g., in units of beats or moments per minute). In some implementations, the user 37 can manually scroll through moments at a tempo of their own choosing, for example by pressing a "next moment" button to scroll through the moments.

The toolbox 48 allows a user to: enter, save, load, or navigate through musical moments; specify filters for displaying musical moments of a particular work; and perform other tasks associated with the musical workstation 36. The electronic representation of the musical instrument 49 is either for the user to input certain values of level of a musical moment (e.g., by clicking notes on the electronic representation of the instrument 49), or for the musical workstation 36 to display notes of a musical moment in an animated performance of a selected portion of a musical work.

Figure 6B:
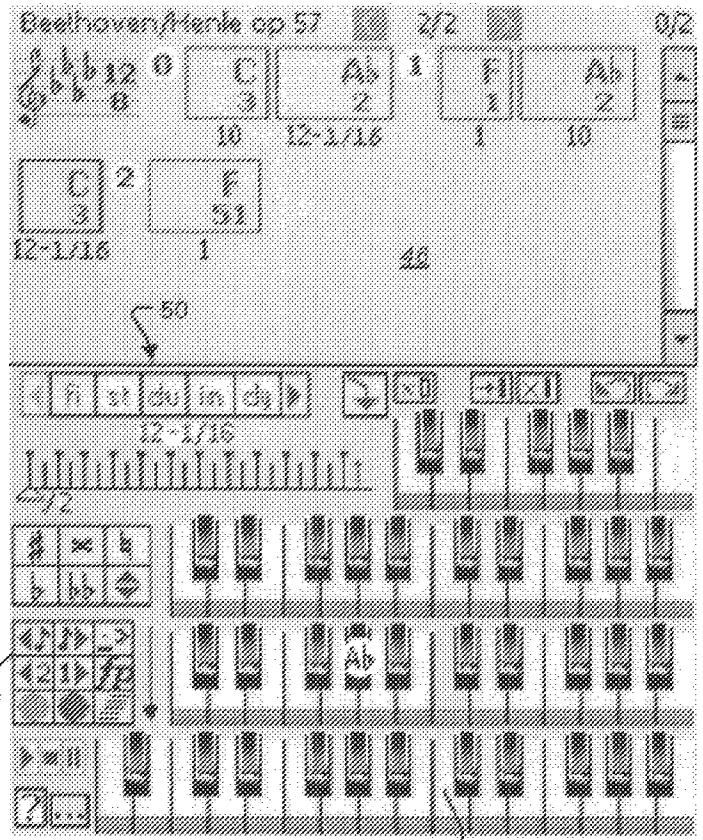
FIGS. 6A-L are exemplary video outputs provided by the musical workstation.
Figure 6A:
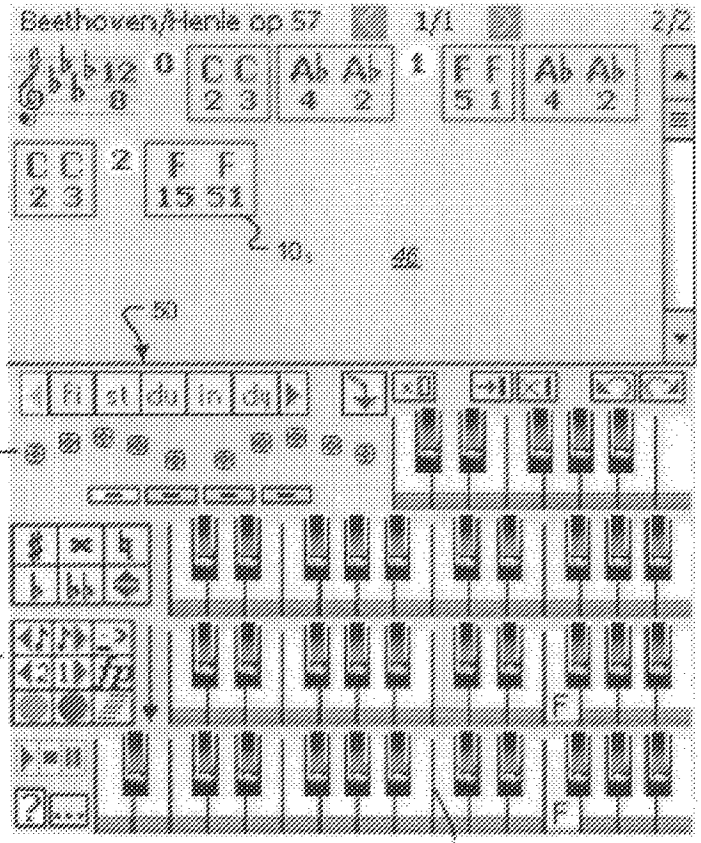
Figure 6D:
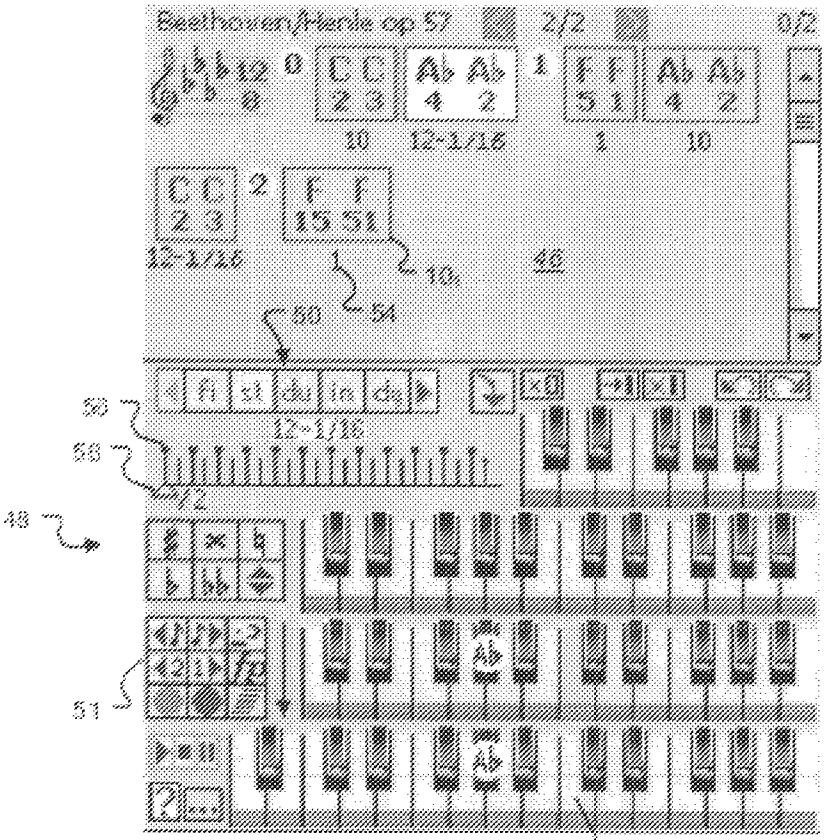
Figure 6C:
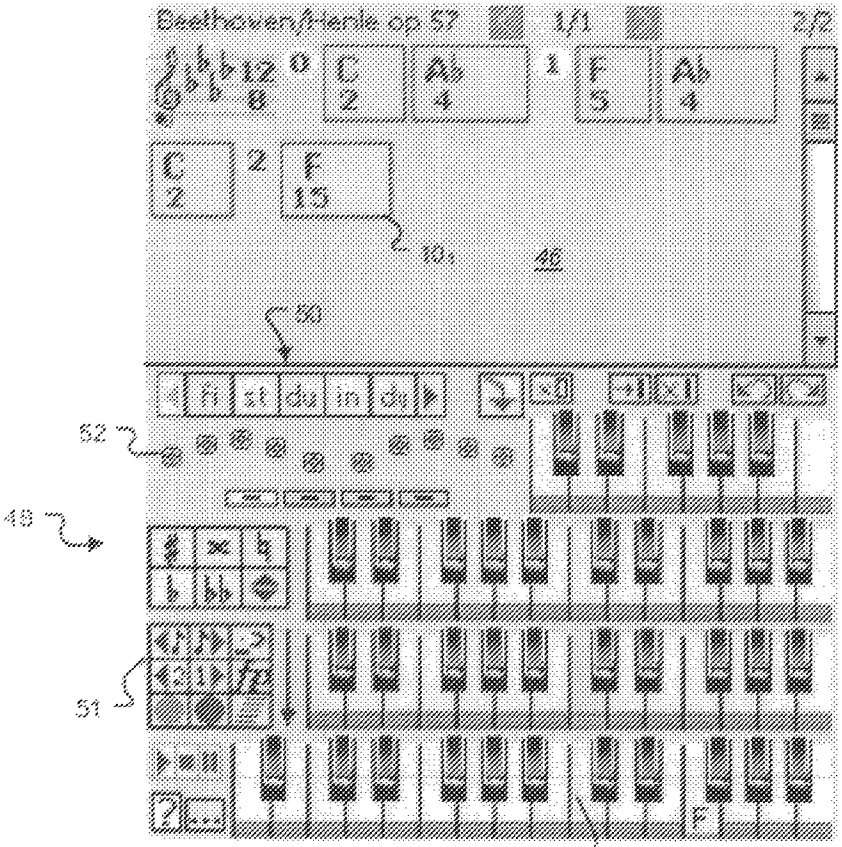
Figure 6F:
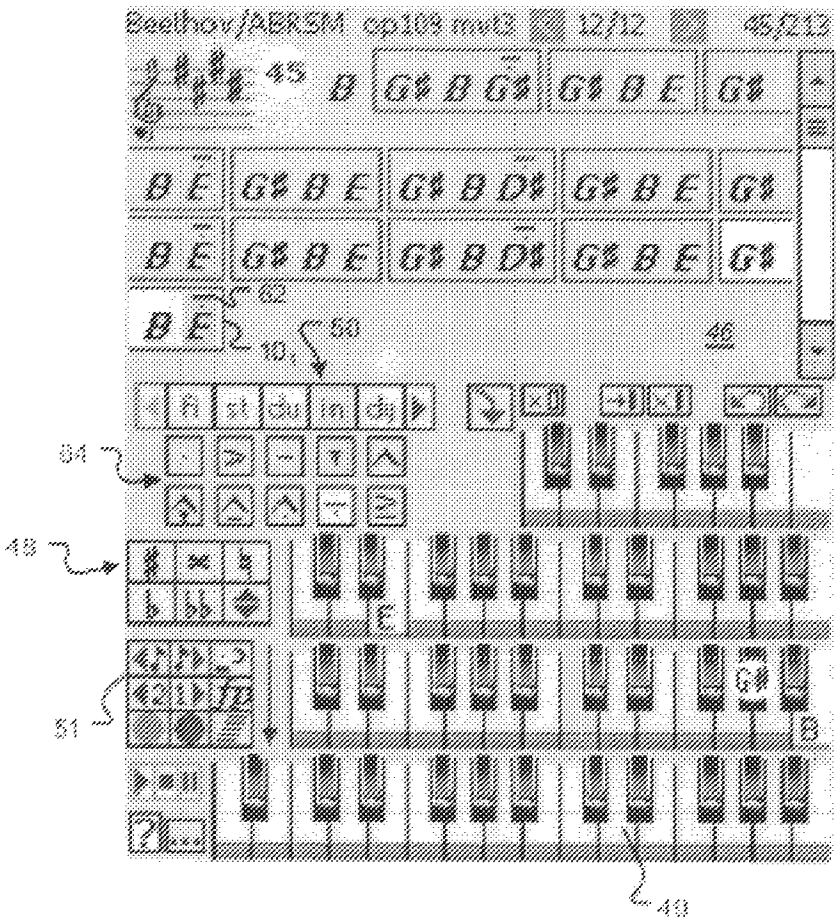
Figure 6E:
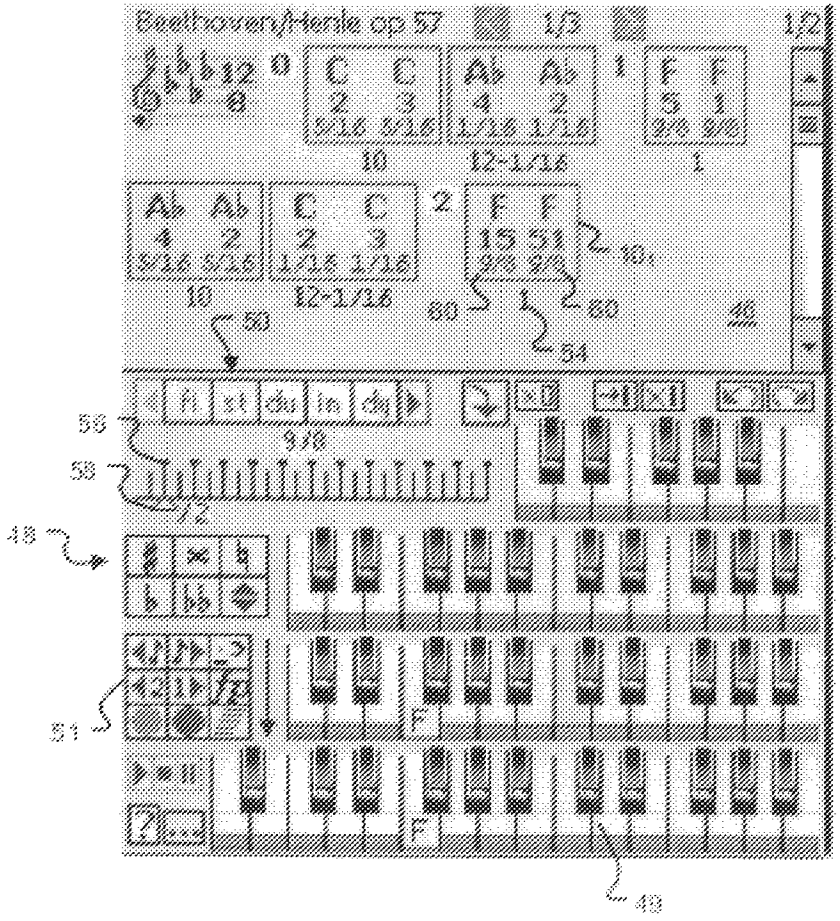
Figure 6H:
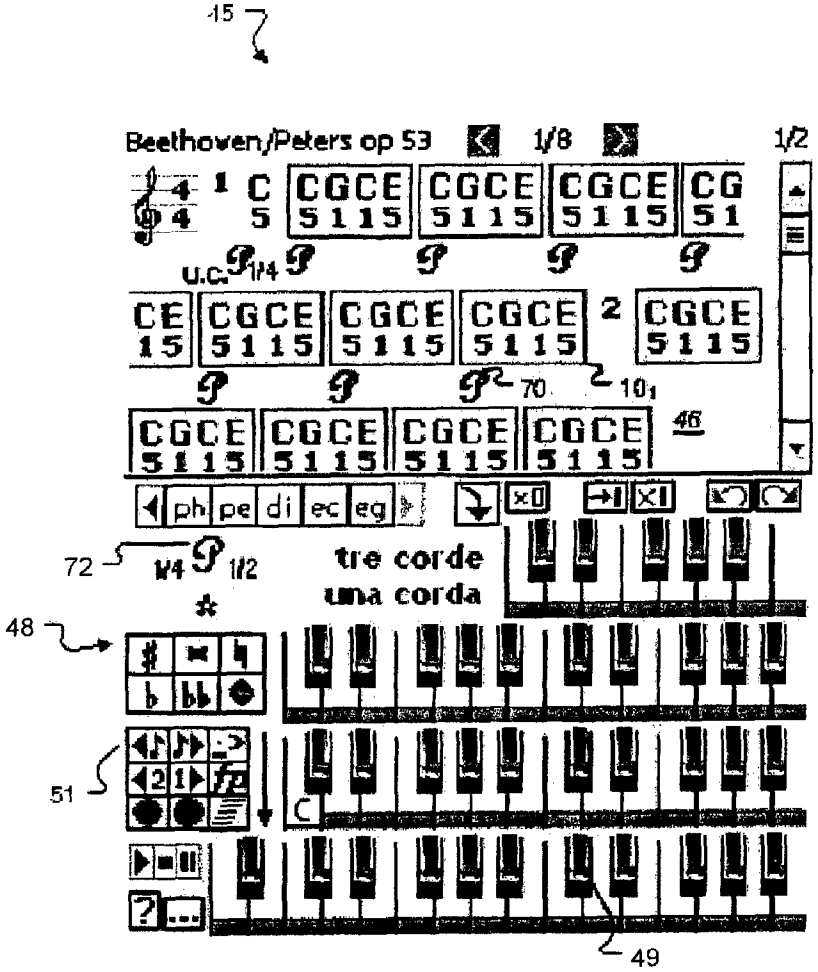

Referring to FIGS. 6A-K, exemplary video outputs 45 are shown. FIG. 6A illustrates an exemplary moment display portion 46, an exemplary toolbox 48, and an exemplary electronic representation of the musical instrument 49. Here, the electronic representation of the musical instrument 49 is a representation of a piano keyboard, but may be any other instrument, including a guitar, a woodwind instrument, a brass instrument, a percussion instrument or assembly of percussion instruments (e.g., a drum kit), etc. In the exemplary toolbox 48, various features have a designated tab or button to be pushed to activate the desired function. In the exemplary toolbox 48, a toolbar 50 is provided to navigate editing menus. The editing menus allow a user to input values 14 for various levels 12, including: fingering (fi), starting points (st), duration (du), inflection (in), dynamics (dy), directives (di) (FIG. 6D), editor comments (ec) (FIG. 6E), editor-defined graphics (eg) (FIG. 6F), pedaling (pe) (FIG. 6G), and phrasing (ph) (FIG. 6H).

The toolbox 48 also includes a filter menu 51. The filter menu 51 allows a user to select one of several pre-defined filters, to view, for example, only right- or left-hand notes of the musical work 11, only dynamics, only inflections, etc. In general, the user may define his own filter.

Referring back to FIG. 6A, the "fingering" (fi) menu includes a schematic depiction 52 of a person's hands. This schematic depiction 52 illustrates which finger corresponds to which note in a musical moment $\mathbf{10}_1$. In some embodiments, the schematic depiction 52 can also be used to input fingerings associated with a particular musical moment, using an input device such as a mouse or a stylus. In some embodiments, multiple sets of fingerings or fingering substitutions can be associated with the same musical moment $\mathbf{10}_1$. Note that the two "F" notes are displayed on the elctronic representation of the musical instrument 49.

In FIG. 6B, a "right-hand" study is shown. FIG. 6B is based on the same musical work 11' as shown FIG. 6A, with the same moments displayed in the exemplary moment display portion 46. However, in FIG. 6B, the left-handed notes are not displayed. Such a presentation would be useful, for example, to someone practicing just the right-hand portion of the musical work 11. Similarly, FIG. 6C is based on the same musical work 11' as FIGS. 6A and 6B, but in FIG. 6C the right-handed notes are suppressed.

In FIG. 6D, which is also based on the same musical work 11 as FIGS. 6A-C, the "starting point" (st) menu is shown. The starting point of a moment is an indication of the moment's relative position is the musical work 11. In FIG. 6D, the starting point 54 of each moment is shown. In some embodiments, when specifying values for the "starting point" level of new moments, the user may input the starting point using a sliding scale 56 divided in pre-defined intervals. Irregular starting points can be entered by successively dividing the pre-defined intervals, using the "Δ/2" button 58.

In this example, the starting point 54 is described by a number, indicating the moment's relative position in a given measure, expressed as a beat. For example, the starting point of moment $\mathbf{10}_1$ is on the first beat of its measure. In principle, any expression of a starting point 54 may be used. In particular, starting points 54 for moments $\mathbf{10}_1, \ldots, \mathbf{10}_n$ within a musical work that does not have a time signature may be accommodated, for example by expressing a starting point 54 as a duration from the beginning of the musical work, or in other ways.

In FIG. 6E, which is also based on the same musical work 11 as FIGS. 6A-D, the "duration" (du) menu is shown. The duration 60 of a moment is its relative length in the musical work 11 (e.g., measured in beats or another unit of time). In FIG. 6E, the duration 60 of each moment is shown. In some embodiments, which specifying values for the "duration" level, the user may input the duration using the sliding scale 56, and can specify irregular durations using the "Δ/2" button 58.

In FIG. 6F, the "inflection" (in) menu is shown. The inflection 62 of a note describes the note's transition into other notes. For example, the "E" note of moment $\mathbf{10}_1$ has the "macato" inflection 62. In some embodiments, when specifying values for the "inflection" level, the user may input inflections using inflection buttons 64, including buttons for: staccato, staccatissimo, spiccato, marcato, sfortzando, rinforzando, legato, and accent mark. These inflection buttons are illustrative only; the musical workstation 36 can accommodate any inflection instructions, including user-defined inflections. In FIG. 6F, note that a filter has been provided so that other information shown in FIGS. 6A-6E is suppressed, for example the fingerings, durations, and starting points of the individual moments.

Figure 6G:
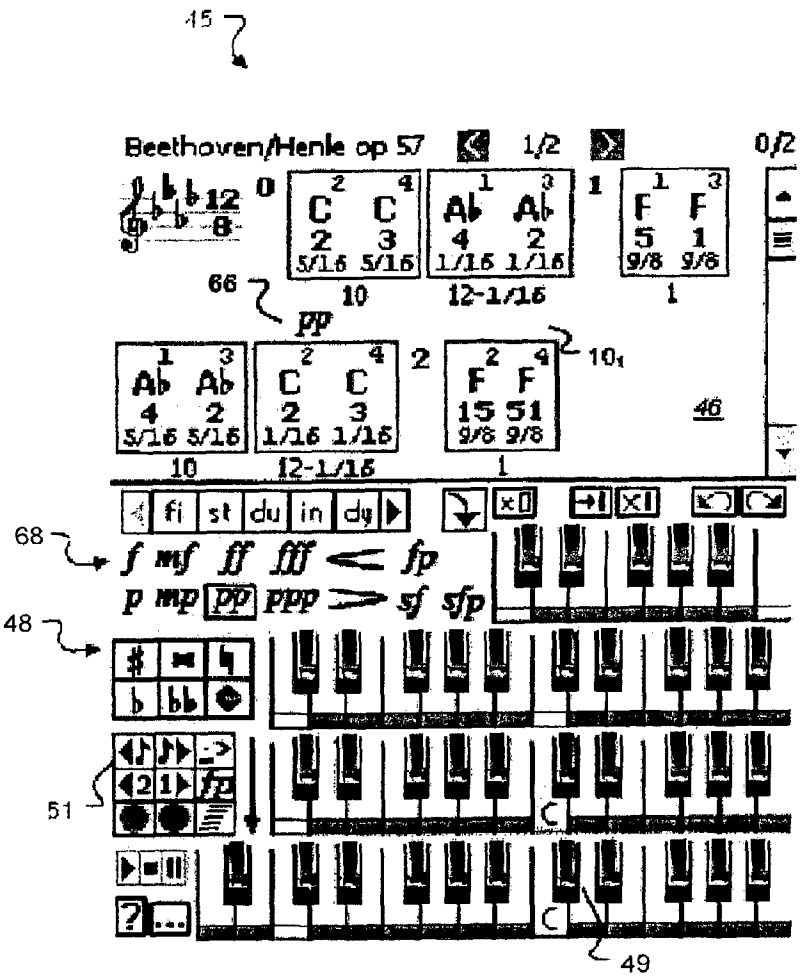

In FIG. 6G, the "dynamics" (dy) menu is shown. The dynamics 66 of a musical moment describe the volume (e.g., loud or quiet) with which the moment is played. In some embodiments, only changes in dynamics are displayed, and not the dynamics of each moment. In some embodiments, when specifying values for the "dynamics" level in a musical moment, the user may input dynamics using dynamics buttons 68, including buttons for forte, mezzo forte, fortissimo, louder dynamics beyond fortissimo, piano, mezzo piano, pianissimo, softer dynamics beyond pianissimo, crescendos, and decrescendos. In some embodiments, the various dynamics correspond to various values 14 of the velocity level 12. The correspondence can be pre-determined, or user-defined.

In FIG. 6H, the "pedaling" (pe) menu is shown. A pedal graphic 70 accompanies a musical moment $\mathbf{10}_1$ where a pedal is to be depressed. In some embodiments, when specifying values for the "pedaling" level, the user may input pedaling values using pedaling buttons 72, including the pedal depth and which pedal (tre cords or una corda) to depress.

Figure 6J:
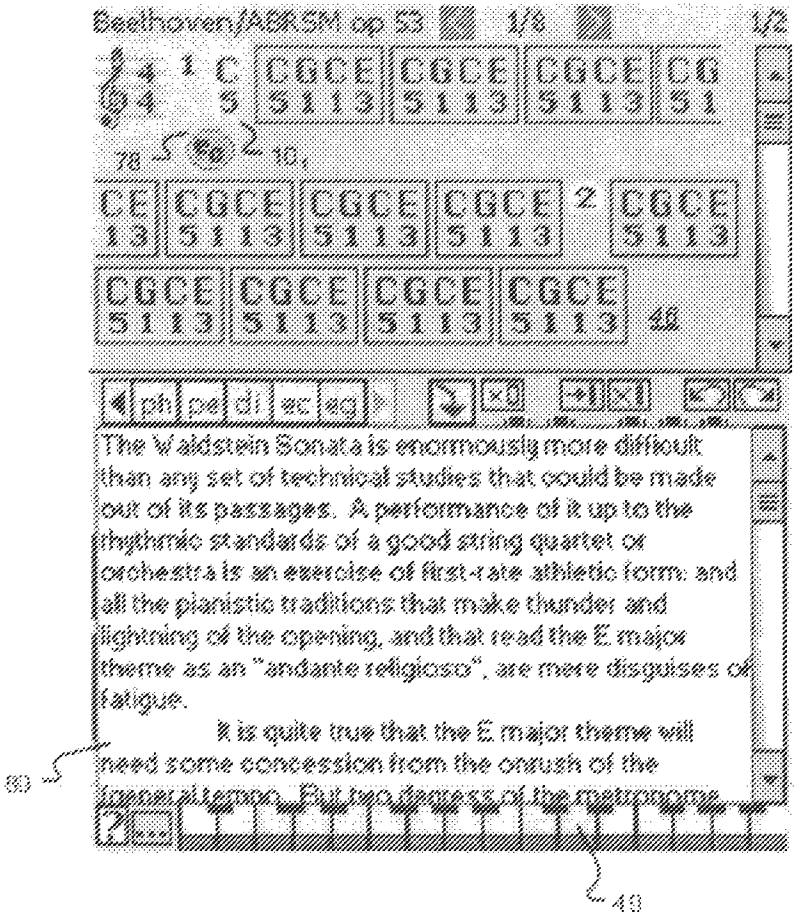
Figure 6I:
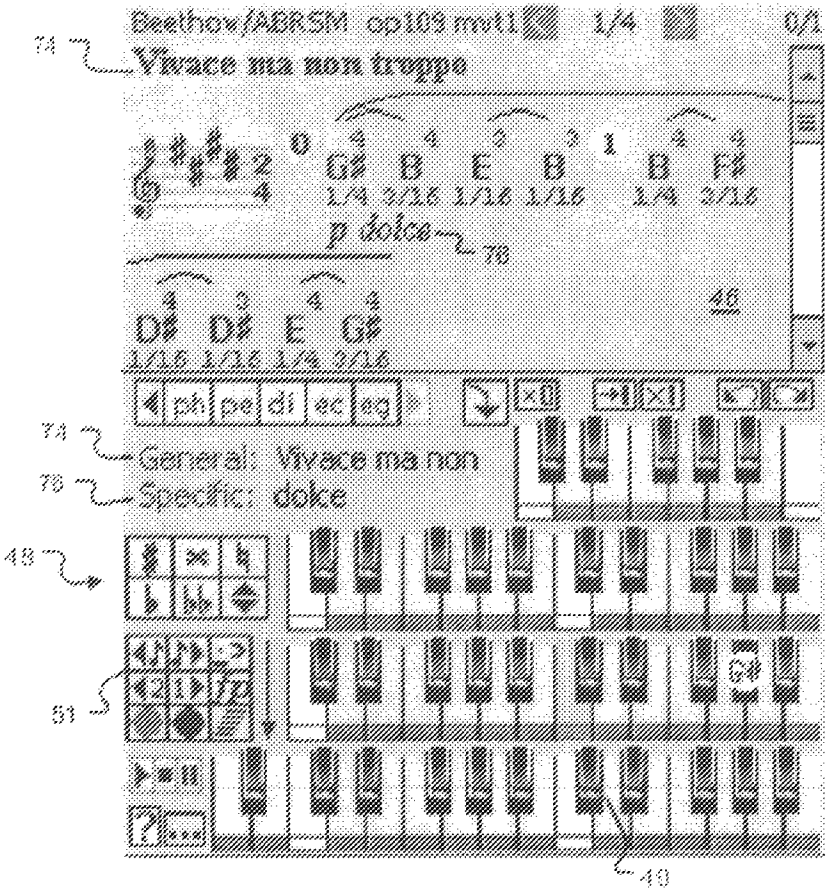

In FIG. 6I, the "directives" (di) menu is shown. A directive is an instruction on the mood of the musical work 11 or a section of the musical work 11. A general directive 74 pertains to the entire musical work, and a specific directive 76 pertains to a section. In some embodiments, only changes in specific directions are specified. In some embodiments, when specifying values for the "directive" levels, a user may use a text entry tool (not shown).

In FIG. 6J, the "editor comments" (ec) menu is shown. Comments may labeled as composer comments, editor comments, or user comments. (This categorization is one of logical convenience only. For example, one need not be employed as an "editor," to make editor comments). Comments may further be labeled as "internal" or "external," depending on the editor's preferences. For example, an editor may decide to label comments on a particular short section as "internal," and comments on large section or the entire musical work 11 as "external." A market 78 is presented for a moment $\mathbf{10}_1$ that has comments associated with it. Selecting the marker 78 displays the comments 80. In some embodiments, when specifying values for the various "comments" levels (e.g., levels 3 and 18 in table 1), a user may use a text entry tool (not shown).

Figure 6L:
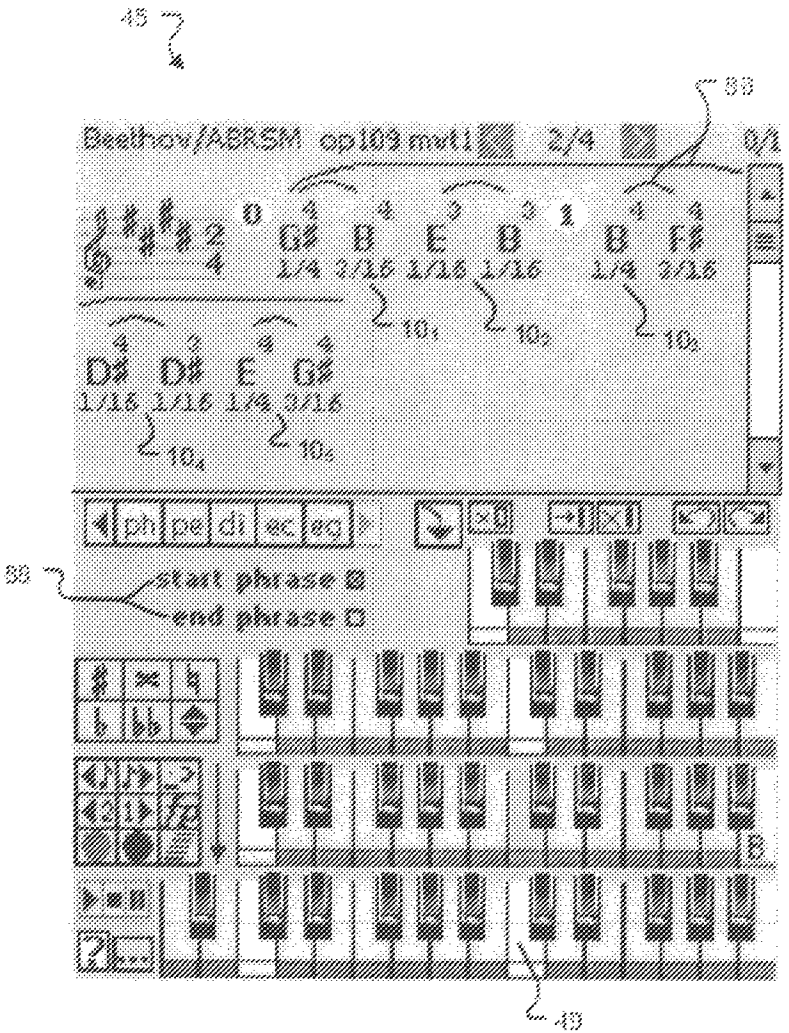
Figure 6K:
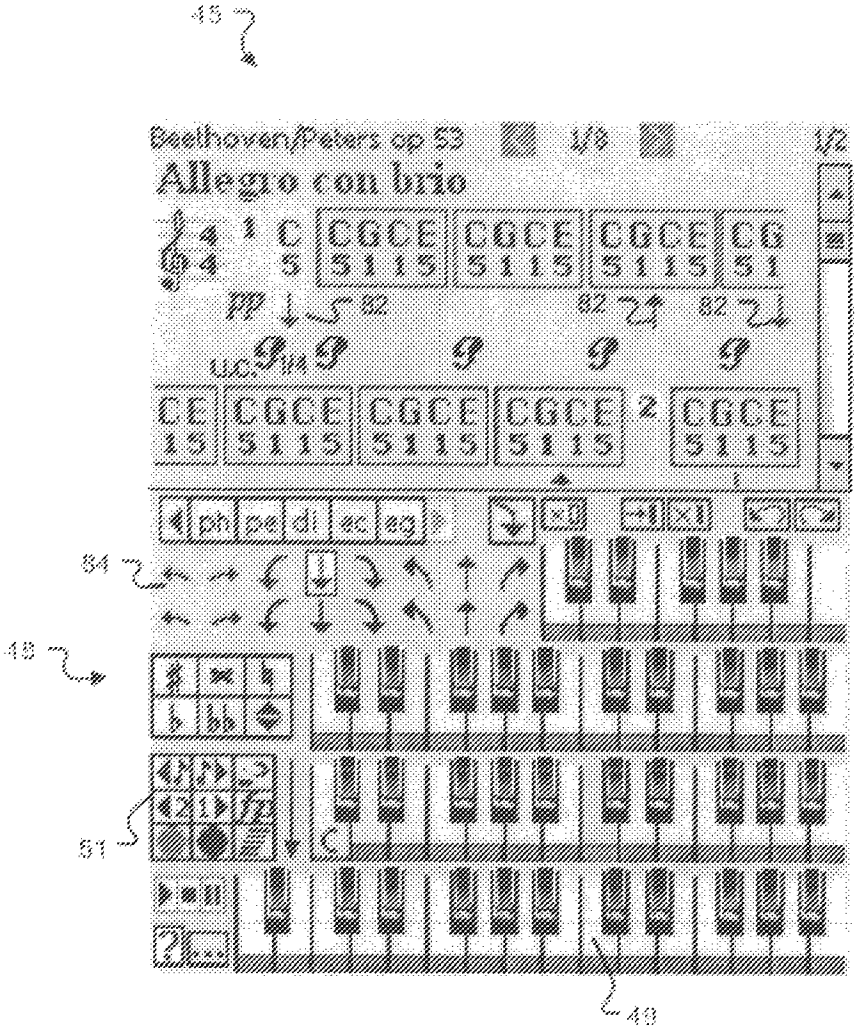

In FIG. 6K, the "editor-defined graphics" (eg) menu is shown. Graphics may be labeled as composer-defined, editor-defined, or user-defined. The ability of the musical workstation 36 to accept externally-defined graphics enhances its flexibility. This flexibility can be desirable, for example, if the composer, editor, or user desires to include a non-standard annotation with the musical moment. For example, the moment $\mathbf{10}_1$ may call for a pianist to clap his hands, stomp his feet, or perform some other unorthodox act during the performance of the musical work 11. Allowing the composer, editor, or user to define graphics allow them to express virtually any idea in the moment $\mathbf{10}_1$.

For example, editor-defined graphics 82 describing the motion of the performer's arms are shown in FIG. 6K. In this example, the graphics 82 describe combinations of up/down and left/right motions. In some embodiments, which specifying values of the "graphics" level, the graphics may be selected from a palette 84 of composers-defined, editor-defined, or user-defined graphics.

In FIG. 6L, the "pharasing" (ph) menu is shown. Phrase marks 86 show groups of notes in a particular moment $\mathbf{10}_3$ or in groups of moments $\mathbf{10}_1, \ldots, \mathbf{10}_5$ joined together in a phrase. In some embodiments, when specifying values of the "phrasing" level of a musical moment, only starting and ending points of phrases are specified. For example, in some embodiments, the starting points and ending points are specified with radio buttons 88.

In some implementations, various musical works 11 (or various interpretations of the same musical work 11) may be displayed simultaneously. For example, the musical works 11 may be displayed side-by-side, or superimposed on each other. Simultaneously displaying musical works 11 allows them to be easily and quickly compared or studied.

In some implementations, the musical workstation 36 can be used as a musician's workstation. One use of the musical workstation 36 in this regard is to help a musician keep a library of musical works 11 organized and up to date. For example, the musical workstation 36 can store a hierarchically-organized library of musical works 11, with various editions of the same musical composition stored at the same level in the hierarchy. Such a library can be useful, for example to research a musical composition, a composer, a time period, etc.

The musical workstation 36 can also be used to sharpen a musician's understanding of a musical work 11. One way this is accomplished is for the musician to transcribe the musical work 11 into moment-based format of the musical workstation 36. Since the moment-based format of the musical workstation 36 is significantly different from traditional musical notation (as in FIG. 1), the task of transcribing a musical work between the formats can require a significant degree of active thought from the transcriber-musician. The active thought forces the musician to confront his or her understanding of the musical work 11. By contrast, merely copying a musical work 11 in the traditional format can degenerate into a "rote" exercise, which tends not to be as instructive.

Other embodiments are within the scope of the following claims.

What is claimed is:

1. A method of expressing a musical work written in standard notational form, comprising:

identifying a sequence of musical moments in the musical work; and for each musical moment, constructing the musical moment as a plurality of levels, each level associated with a discrete musical data-type;

electronically specifying values for the discrete musical data-type for each of the plurality of levels of the musical moment; and displaying values for at least one of the plurality of levels of the musical moment, the values for each level displayed horizontally with respect to one another, the values for one musical moment displayed horizontally with respect to the values for the consecutive musical moment.

2. The method of claim 1, wherein each musical moment of the series of musical moments is displayed at a speed based on a rhythmic pattern of the musical work.

3. The method of claim 1, wherein each musical moment of the series of musical moments is displayed at a speed based on a rhythmic pattern supplied by a user.

4. The method of claim 1, wherein each musical moment of the series of musical moments is displayed in response to input from a user.

5. The method of claim 1, wherein less than all of the values associated with the musical moment are displayed.

6. The method of claim 5, wherein the representations for the values are displayed based on a filter.

7. The method of claim 1, further comprising displaying an electronic representation of a musical instrument.

8. The method of claim 7, further comprising displaying representations for values for one or more of a plurality of levels characterizing aspects of the musical moment on the electronic representation of the musical instrument.

9. The method of claim 7, wherein the musical instrument includes a piano keyboard.

10. The method of claim 7, wherein the musical instrument includes a stringed instrument.

11. The method of claim 1, wherein the musical moment is associated with a plurality of levels characterizing aspects of the musical moment.

12. The method of claim 11, wherein the plurality of levels includes a level for the general direction of the musical work or a metronome marking.

13. The method of claim 11, wherein the plurality of levels includes a level for the general direction of a moment in the series of moments.

14. The method of claim 11, wherein the plurality of levels includes a level for comments about the musical work.

15. The method of claim 11, wherein the plurality of levels includes a level for musical graphics.

16. The method of claim 11, wherein the plurality of levels includes a level for phrasing instructions.

17. The method of claim 11, wherein the plurality of levels includes a level for a key signature for a moment in the series of moments.

18. The method of claim 11, wherein the plurality of levels includes a level for a time signature for a moment in the series of moments.

19. The method of claim 11, wherein the plurality of levels includes a level for a measure number for a moment in the series of moments.

20. The method of claim 11, wherein the plurality of levels includes a level for an open repeat instruction.

21. The method of claim 11, wherein the plurality of levels includes a level for register information for a note or notes in a moment in the series of musical moment.

22. The method of claim 11, wherein the plurality of levels includes a level for an inflection instruction for a moment in the series of musical moments.

23. The method of claim 11, wherein the plurality of levels includes a level for a note name or names for a note or notes in a moment in the series of musical moments.

24. The method of claim 11, wherein the plurality of levels includes a level for a fingering instruction for a moment in the series of musical moments.

25. The method of claim 11, wherein the plurality of levels includes a level for a velocity for a moment in the series of musical moments.

26. The method of claim 11, wherein the plurality of levels includes a level for a duration for a moment in the series of musical moments.

27. The method of claim 11, wherein the plurality of levels includes a level for a line designation for one or more notes in a moment in the series of musical moments.

28. The method of claim 11, wherein the plurality of levels includes a level for a starting point for a moment in the series of musical moments.

29. The method of claim 11, wherein the plurality of levels includes a level for dynamics for a moment in the series of musical moments.

30. The method of claim 11, wherein the plurality of levels includes a level for a pedaling instruction for a moment in the series of moments.

31. The method of claim 11, wherein the plurality of levels includes a level for comments about a musical moment in the series of musical moments.

32. The method of claim 11, further comprising:

electronically specifying values for one or more of the levels; and associating the values with the musical moment.

33. The method of claim 32, further comprising displaying representations for the values associated with the musical moment.

34. The method of claim 33, wherein the representations for the values are displayed in non-overlapping areas.

35. The method of claim 32, wherein electronically specifying values includes electronically specifying values in response to electronic interaction with an electronic representation of a musical instrument.

36. The method of claim 1, wherein each tone is a musical note and the name for each tone is selected from the group consisting of A, A flat (A♭), A sharp (A♯), B, B flat (B♭), C, C sharp (C♯), D, D flat (D♭), D sharp (D♯), E, E flat (E♭), F, F sharp (F♯), G, G flat (G♭), and G sharp (G♯).

37. The method of claim 1, further comprising displaying a visual boundary between adjacent musical moments.

38. The method of claim 1, further comprising allowing a user to edit values for at least one of the plurality of levels.

39. The method of claim 1, wherein the electronically specifying values includes allowing a user to specify values for at lease one of the plurality of levels.

40. A computer-readable medium bearing instructions to cause a computer to:

identify a sequence of musical moments in a musical work written in standard notational form; and for each musical moment, construct the musical moment as a plurality of levels, each level associated with a discrete musical data-type;

electronically specify values for the discrete musical data-type for each of the plurality of levels of the musical moment; and display values for at least one of the plurality of levels of the musical moment, the values for each level displayed horizontally with respect to one another, the values for one musical moment displayed horizontally with respect to the values for the consecutive musical moment.

41. The computer readable medium of claim 40, wherein the instructions cause each musical moment of the series of musical moments to be displayed at a speed based on a rhythmic pattern of the musical work.

42. The computer readable medium of claim 40, wherein the instructions cause each musical moment of the series of musical moments to be displayed at a speed based on a rhythmic pattern supplied by a user.

43. The computer readable medium of claim 40, wherein the instructions cause each musical moment of the series of musical moments to be displayed in response to input from a user.

44. The computer readable medium of claim 40, the instructions further causing the computer to display an electronic representation of a musical instrument.

45. The computer readable medium of claim 44, the instructions further causing the computer to display representations for values for one or more of a plurality of levels characterizing aspects of the musical moment on the electronic representation of the musical instrument.

46. The computer readable medium of claim 44, wherein the musical instrument includes a piano keyboard.

47. The computer readable medium of claim 44, wherein the musical instrument includes a stringed instrument.

48. The computer readable medium of claim 40, wherein the musical moment is associated with a plurality of levels characterizing aspects of the musical moment.

49. The computer readable medium of claim 48, wherein the plurality of levels includes a level for the general direction of the musical work or a metronome marking.

50. The computer readable medium of claim 48, wherein the plurality of levels includes a level for the general direction of a moment in the series of moments.

51. The computer readable medium of claim 48, wherein the plurality of levels includes a level for comments about the musical work.

52. The computer readable medium of claim 48, wherein the plurality of levels includes a level for musical graphics.

53. The computer readable medium of claim 48, wherein the plurality of levels includes a level for phrasing instructions.

54. The computer readable medium of claim 48, wherein the plurality of levels includes a level for a key signature for a moment in the series of moments.

55. The computer readable medium of claim 48, wherein the plurality of levels includes a level for a time signature for a moment in the series of moments.

56. The computer readable medium of claim 48, wherein the plurality of levels includes a level for a measure number for a moment in the series of moments.

57. The computer readable medium of claim 48, wherein the plurality of levels includes a level for an open repeat instruction.

58. The computer readable medium of claim 48, wherein the plurality of levels includes a level for register information for a note or notes in a moment in the series of musical moment.

59. The computer readable medium of claim 48, wherein the plurality of levels includes a level for an inflection instruction for a moment in the series of musical moments.

60. The computer readable medium of claim 48, wherein the plurality of levels includes a level for a note name or names for a note or notes in a moment in the series of musical moments.

61. The computer readable medium of claim 48, wherein the plurality of levels includes a level for a fingering instruction for a moment in the series of musical moments.

62. The computer readable medium of claim 48, wherein the plurality of levels includes a level for a velocity for a moment in the series of musical moments.

63. The computer readable medium of claim 48, wherein the plurality of levels includes a level for a duration for a moment in the series of musical moments.

64. The computer readable medium of claim 48, wherein the plurality of levels includes a level for a line designation for one or more notes in a moment in the series of musical moments.

65. The computer readable medium of claim 48, wherein the plurality of levels includes a level for a starting point for a moment in the series of musical moments.

66. The computer readable medium of claim 48, wherein the plurality of levels includes a level for dynamics for a moment in the series of musical moments.

67. The computer readable medium of claim 48, wherein the plurality of levels includes a level for a pedaling instruction for a moment in the series of moments.

68. The computer readable medium of claim 48, wherein the plurality of levels includes a level for comments about a musical moment in the series of musical moments,

69. The computer readable medium of claim 48, the instructions further causing the computer to:

electronically record values for one or more of the levels; and associate the values with the musical moment.

70. The computer readable medium of claim 69, the instructions further causing the computer to display representations for the values associated with the musical moment.

71. The computer readable medium of claim 70, wherein the instructions cause the representations for the values to be displayed in non-overlapping areas.

72. The computer readable medium of claim 70, wherein the instructions cause less than all of the values associated with the musical moment to be displayed.

73. The computer readable medium of claim 72, wherein the instructions cause the representations for the values to be displayed based on a filter.

74. The computer readable medium of claim 69, the instructions further causing the computer to electronically record values for one or more of the levels in response to electronic interaction with an electronic representation of a musical instrument.

75. The computer readable medium of claim 69, the instructions further causing the computer to display a visual boundary between adjacent musical moments.

76. The computer readable medium of claim 40, wherein each tone is a musical note and the name for each tone is selected from the group consisting of A, A flat (A♭), A sharp (A♯), B, B flat (B♭), C, C sharp (C♯), D, D flat (D♭), D sharp (D♯), E, E flat (E♭), F, F sharp (F♯), G, G flat (G♭), and G sharp (G♯).

77. The computer-readable medium of claim 40, wherein the instructions to cause a computer to electronically specify values include instructions to cause a computer to allow a user to electronically specify values for at least one of the plurality of levels.

78. The computer-readable medium of claim 40, the instructions further causing the computer to allow a user to edit values for at least one of the plurality of levels.

* * * * *